US009846986B2

(12) United States Patent
Adams

(10) Patent No.: US 9,846,986 B2
(45) Date of Patent: Dec. 19, 2017

(54) ELECTRONIC INTERFACE, WAGERING SYSTEMS AND METHODS FOR WAGERING GAMES

(71) Applicant: Timothy Adams, Las Vegas, NV (US)

(72) Inventor: Timothy Adams, Las Vegas, NV (US)

( * ) Notice: Subject to any disclaimer, the term of this patent is extended or adjusted under 35 U.S.C. 154(b) by 0 days.

(21) Appl. No.: 15/177,339

(22) Filed: Jun. 8, 2016

(65) Prior Publication Data

US 2017/0287262 A1 Oct. 5, 2017

Related U.S. Application Data

(60) Provisional application No. 62/172,780, filed on Jun. 8, 2015.

(51) Int. Cl.

| | |
|---|---|
| ***G07F 17/32*** | (2006.01) |
| ***A63F 5/04*** | (2006.01) |
| *A63F 9/24* | (2006.01) |

(52) U.S. Cl.

CPC ..... *G07F 17/3213* (2013.01); *A63F 5/04* (2013.01); *G07F 17/3262* (2013.01); *A63F 2009/2454* (2013.01)

(58) Field of Classification Search

None

See application file for complete search history.

(56) References Cited

U.S. PATENT DOCUMENTS

| | | | | |
|---|---|---|---|---|
| 2002/0169017 | A1* | 11/2002 | Visoenik | A63F 3/00157 463/16 |
| 2012/0172103 | A1* | 7/2012 | Gurule | G07F 17/3258 463/17 |
| 2014/0094280 | A1* | 4/2014 | Berman | G07F 17/3258 463/25 |

* cited by examiner

*Primary Examiner* — Damon Pierce

(74) *Attorney, Agent, or Firm* — Newman Law, LLC

(57) ABSTRACT

Systems and methods for facilitating wagering in wagering games by presenting through a display device a user interface comprising a representation of a segmented ring, wherein each segment of the displayed segmented ring corresponds with a wagering option associated with a wagering game; receiving, through the user interface, input from a player relating to one or more desired wagers, wherein the input is received by detecting physical contact with the display device in the area of the segmented ring; and responsive to the input received, presenting, by the display device, a graphical representation of the one or more desired wagers, wherein the graphical representation comprises a form visible on the user interface, the form having a positional element relative to the displayed segmented ring indicating the outcome being wagered on and a dimensional element relative indicating the amount being wagered.

20 Claims, 8 Drawing Sheets

ELECTRONIC INTERFACE, WAGERING SYSTEMS AND METHODS FOR WAGERING GAMES

BACKGROUND OF THE INVENTION

The invention is directed to wagering games, and more particularly, electronic interfaces for enabling wagering on roulette games typically found in gaming establishments, such as those involving a roulette wheel and ball or virtual representations thereof.

Roulette is a well-known casino game which has been played for many years. A typical roulette game consists of a table with betting layout adjacent to a roulette wheel rotor or ring mounted for rotational motion within a support structure. The ring includes a circular array of numbered segments bearing numbers 1 through 36 defined on its upper surface. American Roulette wheels typically have rings which also include the numbers 0 and 00 disposed at diametrically opposite locations on the upper surface, whereas European Roulette wheels include only the number 0. The numbers 1 through 36 are not disposed in numerical order, but rather are typically disposed in a predetermined arrangement, such that roulette wheels located in different casinos will have the same standard predetermined number ring arrangement. The numbers disposed in a circular array in the number ring region of the wheel bear the alternating colors of red and black, with the exception of the 0 and/or 00 numbers, which are typically colored green. A ring of pockets corresponding in number to the plurality of numbers of the ring lies adjacent but radially inward of the number ring on the typical roulette wheel. A typical roulette wheel further includes a central cone and a circular, inclined ball track radially outwardly of the ring.

In operation of a typical roulette game, players place chips or tokens on a betting layout located on a roulette table, and then the croupier or dealer spins the roulette wheel and the roulette ball is placed in motion along the circular ball track in the opposite direction of the rotation of the wheel. As the wheel slows, the ball moves radially inwardly and comes to rest in one of the pockets associated with a particular one of the numbers of the number ring. After the ball comes to rest in one of the pockets, the croupier or dealer settles the various wagers placed on the table layout in accordance with predetermined rules and wager odds and the process is repeated.

Gaming establishments or casinos continually require new games to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

SUMMARY OF THE INVENTION

In some embodiments, the invention is generally directed to a system and method for facilitating wagering games, and various wagering options, through an electronic interface incorporating a display device and processor, in which one or more forms are visually displayed and modifiable responsive to user interaction with a user interface displayed on a display device, wherein the forms are positioned and dimensioned to visually represent wagers to be placed (and eventually placed) in the wagering game.

Some embodiments of the invention are directed to a method of facilitating wagering through an electronic player terminal operatively associated with a processor, a display device, memory and a program stored in the memory, the program being executable by the processor, the method comprising the steps of: presenting, by the display device, a user interface comprising a representation of a segmented ring, wherein each segment of the displayed segmented ring corresponds with a wagering option associated with a wagering game; receiving, through the user interface, input from a player relating to one or more desired wagers, wherein the input is received by detecting physical contact with the display device in the area of the segmented ring; and responsive to the input received, presenting, by the display device, a graphical representation of the one or more desired wagers, wherein the graphical representation comprises a form visible on the user interface, the form having a positional element relative to the displayed segmented ring indicating the outcome being wagered on and a dimensional element relative indicating the amount being wagered.

In some embodiments, the segmented ring comprises a roulette wheel number ring.

In some embodiments, the form is arcuate.

In some embodiments, the form is positioned concentrically relative to the segmented ring.

In some embodiments, the form is in a radially inner position relative to the segmented ring.

In some embodiments, the form is in a radially outer position relative to the segmented ring.

In some embodiments, the visual positional element is the displayed radial position of the form relative to a wagering option on the displayed segmented ring, wherein a position along the same radius indicates the wagering option being wagered on through the user interface.

In some embodiments, the visual dimensional element is the displayed radial length of the form, wherein the radial length of the form is directly proportional to the monetary amount being wagered through the user interface.

In some embodiments, the visual dimensional element is the displayed axial appearance of the form, wherein the extent of the axial appearance of the form is directly proportional to the monetary amount being wagered.

In some embodiments the aforementioned method further comprises the step of placing the one or more wagers in the wagering game corresponding to the input received.

Some embodiments of the invention are directed to a method of facilitating wagering through an electronic player terminal operatively associated with a processor, a display device, memory and a program stored in the memory, the program being executable by the processor, the method comprising the steps of: presenting, by the display device, a user interface comprising a representation of a roulette wheel number ring; receiving, through the user interface, input from a player relating to one or more desired wagers, wherein the input is received by detecting physical contact with the display device in the area of the roulette wheel number ring; and responsive to the input received, presenting, by the display device, a graphical representation of the one or more desired wagers, wherein the graphical representation comprises a form visible on the user interface, the form having a positional element relative to the displayed roulette wheel number ring indicating the outcome being wagered on and a dimensional element relative indicating the amount being wagered.

In some embodiments, the form is in a radially inner position relative to the displayed roulette wheel number ring.

In some embodiments, the visual positional element is the displayed radial position of the form relative to a number on the displayed roulette wheel number ring, wherein a position along the same radius indicates the roulette wheel number being wagered on through the user interface.

In some embodiments, the visual dimensional element is the displayed radial length of the form, wherein the radial length of the form is directly proportional to the monetary amount being wagered through the user interface.

In some embodiments, the visual dimensional element is the displayed axial appearance of the form, wherein the extent of the axial appearance of the form is directly proportional to the monetary amount being wagered.

Some embodiments of the invention are directed to a system, comprising: a display device configured to present a user interface comprising a representation of a segmented ring, wherein each segment of the displayed segmented ring corresponds with a wagering option associated with a wagering game; and a processor configured to: determine the one or more desired wagers to be placed in the wagering game based on the input received from a player, wherein the input is received by detecting physical contact with the display device in the area of the displayed segmented ring; responsive to the input received, present on the display device, a graphical representation of the one or more desired wagers, wherein the graphical representation comprises a form visible on the user interface, the form having a positional element relative to the displayed segmented ring indicating the outcome being wagered on and a dimensional element relative indicating the amount being wagered; and determine the potential award to be provided response to the one or more desired wagers being won in the wagering game.

In some embodiments of the system the segmented ring comprises a roulette wheel number ring.

In some embodiments of the system the visual positional element is the displayed radial position of the form relative to a wagering option on the displayed segmented ring, wherein a position along the same radius indicates the wagering option being wagered on through the user interface.

In some embodiments of the system the visual dimensional element is the displayed radial length of the form, wherein the radial length of the form is directly proportional to the monetary amount being wagered through the user interface.

In some embodiments of the system the visual dimensional element is the displayed axial appearance of the form, wherein the extent of the axial appearance of the form is directly proportional to the monetary amount being wagered.

DETAILED DESCRIPTION OF THE INVENTION

Figure 1:
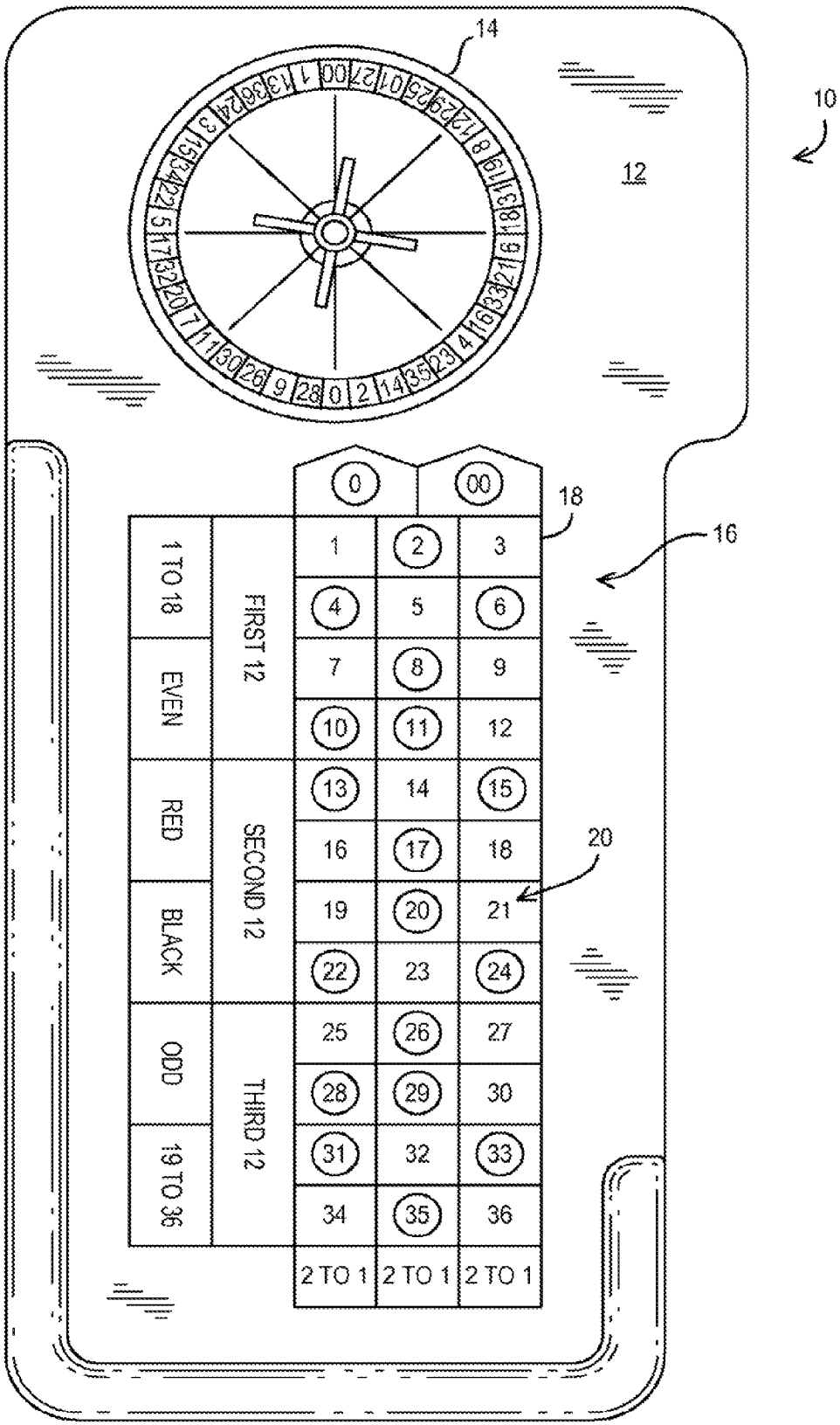
FIG 1 PRIOR ART
FIG. 1 illustrates a plan view of a conventional roulette table.

FIG. 1 illustrates a plan view of a conventional roulette table 10. The roulette table 10 typically has a planar surface 12 on which a roulette wheel 14 is positioned in such a manner that the roulette wheel 14 may spin freely as is well understood. A betting field 16 is disposed opposite the roulette wheel 14 and includes indicia 18 that delimit individual bet options 20.

In practice, players purchase chips from the croupier and place bets by positioning their chips relative to the indicia 18 such that a bet option 20 is selected. The croupier spins the roulette wheel 14 and introduces a ball into the roulette bowl. The ball moves around the wheel 14 in a direction opposite the rotation of the wheel 14. Friction slows the ball until it falls into a labeled cup on the wheel 14 as is well understood. The croupier collects the chips from the losing wagers and dispenses chips for the winning wagers. The process then repeats. Roulette wheel 14, as illustrated, is a U.S. style roulette wheel and the present disclosure focuses on the U.S. style of a roulette wheel, but the teachings set forth herein are generally applicable to a European wheel. Note that the number placement differs between the U.S. style and the European style.

Conventional betting options presented on the table 10 include the numbers individually (a straight or straight up bet), even, odd, red, black, low (numbers one through eighteen), high (numbers nineteen through thirty-six), first twelve (numbers one thorough twelve), second twelve (numbers thirteen through twenty-four), third twelve (numbers twenty-five through thirty-six), first column (numbers one, four, seven, ten, thirteen, sixteen, nineteen, twenty-two, twenty-five, twenty-eight, thirty-one, and thirty-four), second column (numbers two, five, eight, eleven, fourteen, seventeen, twenty twenty-Three, twenty-six, twenty-nine, thirty-two, and thirty-five), and third column (numbers three, six, nine, twelve, fifteen, eighteen, twenty-one, twenty-four, twenty-seven, thirty, thirty-three, and thirty-six). Each of these bet options has explicit indicia 18 on the table 10.

There are other conventional wagers that do not have specific indicia, but whose import is known to roulette players. A split bet is a wager on two numbers that appear next to one another in the indicia 18. This wager is denoted by placing a chip on the line between the two bet options (e.g. line between the two bet options (e.g. the line between one and four or twenty-nine and thirty). A street bet (sometimes called a row bet) is a wager on three numbers on the same row. This wager is denoted by placing a chip outside the row of numbers on which the wager rides (e.g., to wager on one-two-three, the chip is placed on the line that is the outside edge of the three). A corner bet is a wager on four adjoining numbers as designated by the indicia 18. This wager is denoted by placing a chip at the four-way intersection of the four numbers (e.g., at the intersection of thirty-one, thirty-two, thirty-four, and thirty-five). A square bet is a wager on zero, one, two, or three and is denoted by placing the chip at the intersection of zero and three at the corner of a European style wheel. A five number bet is similar to the square bet, but adds the double zero. This wager is denoted by placing a chip at the intersection of zero and one, on the corner. A line bet is in essence wagering on two streets or rows. This wager is denoted by placing a chip on the outer intersection of the two rows in question (e.g. to bet on seven through twelve, a chip would be placed at the outer intersection of nine and twelve).

As a note of nomenclature, the roulette bets set forth above are sometimes divided into two categories called inside bets which include straight, split, street, corner, five, and line bets and outside bets which include red/black, odd/even, low/high, columns, and dozens.

French roulette (which uses the European style wheel 14) has a number of called bets that are honored by some gaming establishments. These bets are not typically designated by indicia 18, but may be explicitly set forth on certain tables. One called bet is the "voisins de zero" or "neighbors of zero" which covers the arc of numbers around the zero on the wheel. Note that since wheel 14 is a U.S. style wheel, the illustrated numbers do not match up with the recited numbers herein; however, on an actual European style wheel, this arc of numbers includes twenty-two, eighteen, twenty-nine, seven, twenty-eight, twelve, thirty-five, three, twenty-six, zero, thirty-two, fifteen, nineteen, four, twenty-one, two, and twenty-five. When selected, nine chips (or a multiple thereof) are placed, two each on the intersection of zero/two-three and twenty-five/twenty-six/twenty-eight/twenty-nine and one each on four/seven, twelve/fifteen, eighteen/twenty-one, nineteen/twenty-two, and thirty-two/thirty-five. A second called bet is the "Tiers du Cylindre" and covers twelve numbers with six chips (or a multiple thereof), two numbers per chip. The numbers are twenty-seven, thirteen, thirty-six, eleven, thirty, eight, twenty-three, ten, five, twenty-four, sixteen, and thirty-three. A third called bet is the "Orphelins" or "Orphans" which is a bet on the bow-tied shaped middle section of the wheel not covered by the Voisins or Tier called bets. The numbers covered are seventeen thirty-four, six, one, twenty, fourteen, thirty-one, and nine. When selected five chips are bet. These five chips will cover the number one with one chip and the numbers six/nine, fourteen/seven, seventeen/twenty, and thirty-one/thirty-four, each with one chip. A fourth called bet is a "number and neighbor" bet which bets on the number and two neighboring numbers on each side relative to the wheel 14. It takes five chips (or a multiple thereof) to cover this wager (one for each number in the bet). A fifth called bet is a "final bet". This wager covers all numbers with the same last number (e.g., four, fourteen, twenty-four, and thirty-four). It takes four chips (or a multiple thereof) to cover this wager. Typically, only numbers one through six are eligible for final bets because numbers seven-nine only have three instances on the wheel.

A summary of the conventional wagers and the odds are presented below in Table 1.

TABLE 1

| Wager Name | Number of Numbers Covered | Odds | |
|---|---|---|---|
| Straight Up Bet | 1 | 35:1 | |
| Split Bet | 2 | 17:1 | |
| Street (row) Bet | 3 | 11:1 | |
| Corner Bet | 4 | 8:1 | |
| Square Bet | 4 (0, 1, 2, 3) | 8:1 | |
| Five Number Bet | 5 (0, 00, 1, 2, 3) | 6:1 | |
| Line Bet | 6 | 5:1 | |
| Dozens | 12 | 2:1 | |
| Columns | 12 | 2:1 | |
| Low/High | 18 | 1:1 | |
| Odd/Even | 18 | 1:1 | |
| Red/Black | 18 | 1:1 | |
| Voisins de Zero | 17 | 0, 2, 3 | 11:1 |
| | | 25, 26, 28, 29 | 8:1 |
| | | 4, 7, 12, 15, 18 | 17:1 |
| | | 19, 21, 22, 32, 35 | 17:1 |
| Tiers du Cylindre | 12 | 17:1 | |
| Orphelins | 8 | 1 | 35:1 |
| | | 6, 7, 9, 14, 17 | 17:1 |
| | | 20, 31, 34 | 17:1 |
| Neighbor | 5 | 35:1 | |
| Final | 4 | 8:1 | |

As used herein the wagers set forth in Table 1 are defined to be standard wagers. Conversely, as used herein, nonstandard wagers are those wagers, which are not standard wagers as that term is defined herein.

Figure 2:
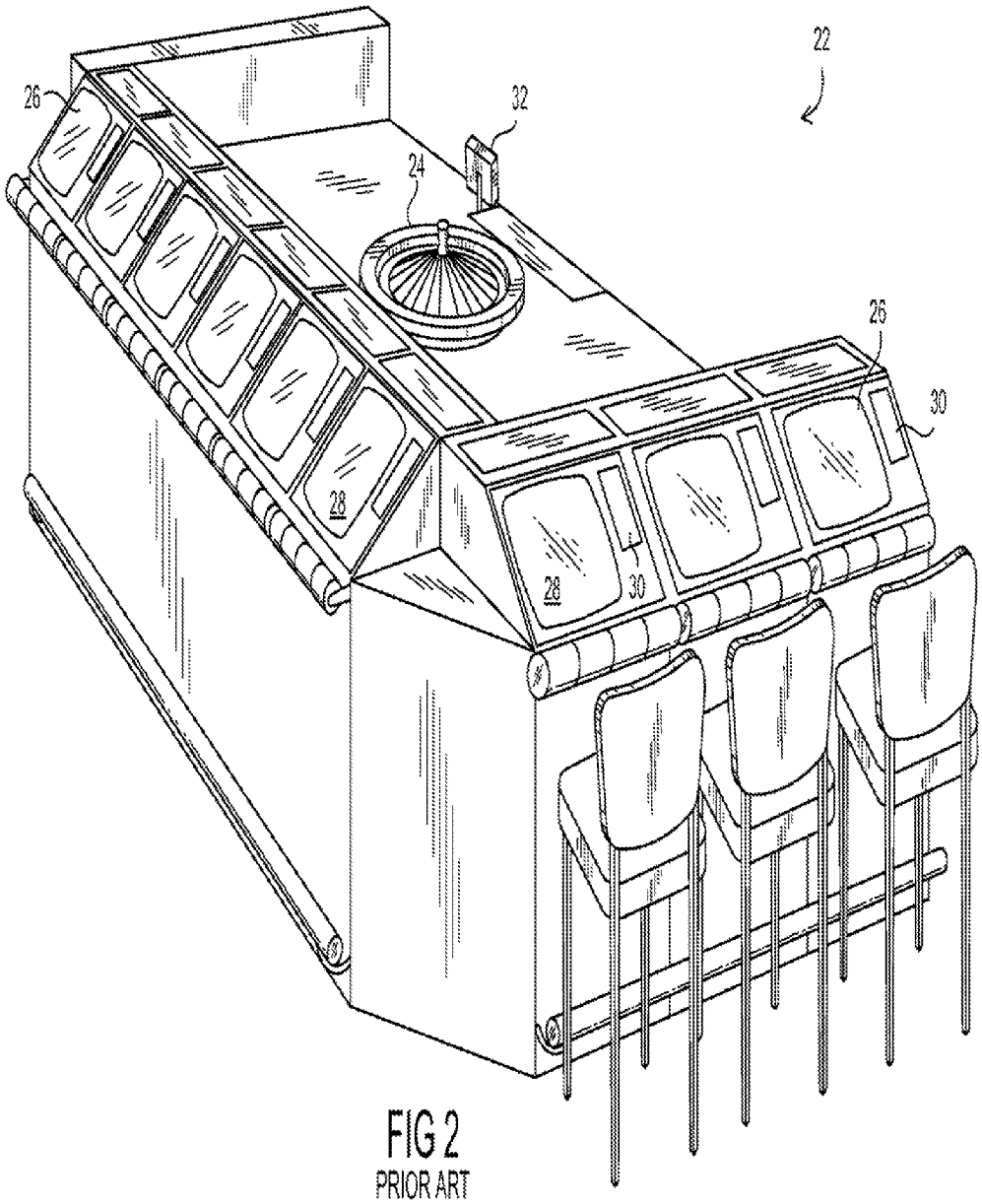
FIG 2 PRIOR ART
FIG. 2 illustrates a perspective view of a conventional roulette table with video terminal betting stations.

A conventional electronic roulette table 22 is illustrated in FIG. 2. The electronic roulette table 22 includes a wheel 24 having a number ring 50, which may be either European or U.S. style that is a physical or virtual wheel presented on a display, such as a centrally located display device. In place of the betting area 16, the electronic roulette table 22 includes a plurality of player terminals 26 which include a display 28 and a user interface 30. Each display 28 presents a video representation of a betting layout essentially identical to betting area 16 complete with indicia 18 and betting options 20. The display 28 may be a touch screen. Players are able to play the game of roulette through the user interface 30 in generally the same manner discussed above, with credits being managed and accounted for added for use in play such as by inserting cash into a bill acceptor, using a cashless receipt system, or the like. Wagers are then made by touching the touch screen or other command functions of the user interface 30.

While the player terminals 26 are shown as being formed within the table 22, this is not required. Rather, the player terminals 26 may be operatively coupled to the table 22 through any appropriate network means. For example, some player terminals 26 may be embodied in mobile terminals such as cellular phones or other remote devices communicatively coupled to the table 22 through a network and wireless interface or the like.

The table may include a controller with a central processing unit (CPU) and memory. Software programs and databases may be stored in memory. The CPU may access programs and databases through any appropriate technique to facilitate operation of the functions described herein. The controller may also act as a server for the client player terminals and a croupier interface for monitoring table play among other things. The controller may also be communicatively coupled through a communication port and network to a remote server.

In the event that the wheel is an electronic or virtual wheel, a random number generator may be used. Such a random number generator may generate data representing random or pseudo-random values (referred to as "random numbers" herein). The random number generator may generate a random number every predetermined unit of time (e.g., every second) or in response to an initiation of a game. In the former embodiment, the generated random numbers may be used as they are generated (e.g., the random number generated at substantially the time of game initiation is used for that game) and/or stored for future use in the memory. Such a random number generator may be embodied as a processor separate from but working in cooperation with the CPU. Alternatively, the random number generator may be embodied as an algorithm, program component, or software program stored in the memory or other device and used to generate a random number. While not illustrated, some or all of the elements set forth herein may be embodied as a peripheral device rather than integrated into the table 22.

U.S. Pat. Nos. 6,659,866 and 7,740,535, both of which are incorporated herein by reference in their entireties, provide additional information about electronic roulette tables, such as table 22.

In the exemplary embodiments of the invention discussed herein, a player having established credit in the terminal, may tap or otherwise use a finger to manipulate graphical representations on a user interface shown on the display 28 responsive thereto, such as those constructed according to the invention and as described herein. One tap may equal one unit wager and additional taps may add unit wagers, a swiping motion may remove a unit wager or add wagers, depending on the embodiment, and using two fingers at the same time or holding a finger against the screen may allow for a player to place multiple wagers.

In some embodiments, the system and method of the invention are configured to display a segmented ring of wagering options on a user interface, such as a roulette wheel number ring, with each segment corresponding to a wager in the wagering game, such as a number to be wagered on in roulette. Players cause the appearance of a visible form on the user interface adjacent to the segments of the ring through the tapping or other types of contact. The form may be an arcuate short or elongated form concentric with the ring, wherein the position of the form relative to the ring, that is, the form being along the same radial from a segment, either positioned radially inward or outward of the segment, indicates that the wagering option associated with that segment is being wagered on. The radially extent of the form, that is, the length of the form along the radial from a segment indicates the monetary amount of the wager, with the amount or unit wagered being directly proportional to the length of the form along any radial from a segment.

The forms may be created responsive to the player dragging their finger along the display device, wherein the system processor determines the potential award for winning a wager corresponding to the potential outcomes or wagering options selected. Once a time period has ended the wagering game will proceed and an award will be provided if game outcome is determined by the processor to match the selected wagering option.

Figure 3:
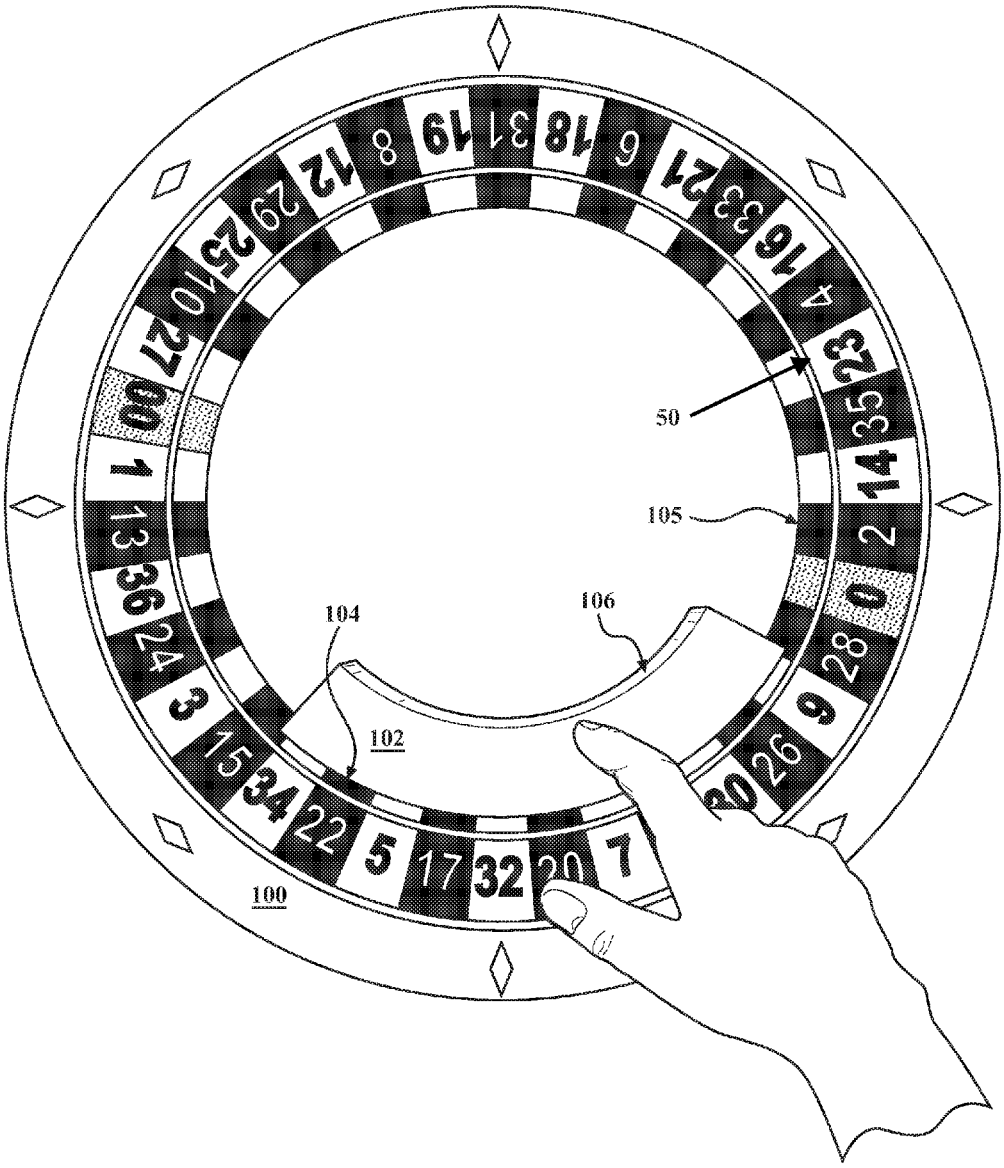
FIG. 3 through 8 provide examples of user interfaces configured according to embodiments of the invention.

FIG. 3 illustrates an embodiment of player interface 100 displayed on a touchscreen display device associated with a live, virtual or electronic roulette game, such as a display 28. Interface 100 includes a depiction of a roulette wheel number ring 50. Interface 100 is configured to be responsive to form a virtual or graphical representation of the wager form 102 positioned concentrically at a radially inner position relative to ring 50 upon interface 100 being touched by a human finger, which is shown in the figures for illustrative purposes only. In other words, form 102 being in a direct radially position 104 relative to a segment 105 corresponds to a wager being placed on the numbers shown in the segment 105 being wagered on in the game of roulette. Since the display 28 includes a ring 50, each form 102 is arcuate and concentric with the shape of ring 50. It should be readily apparent that form 102 is not limited to any one particular shape but rather may be in any form.

Figure 4:
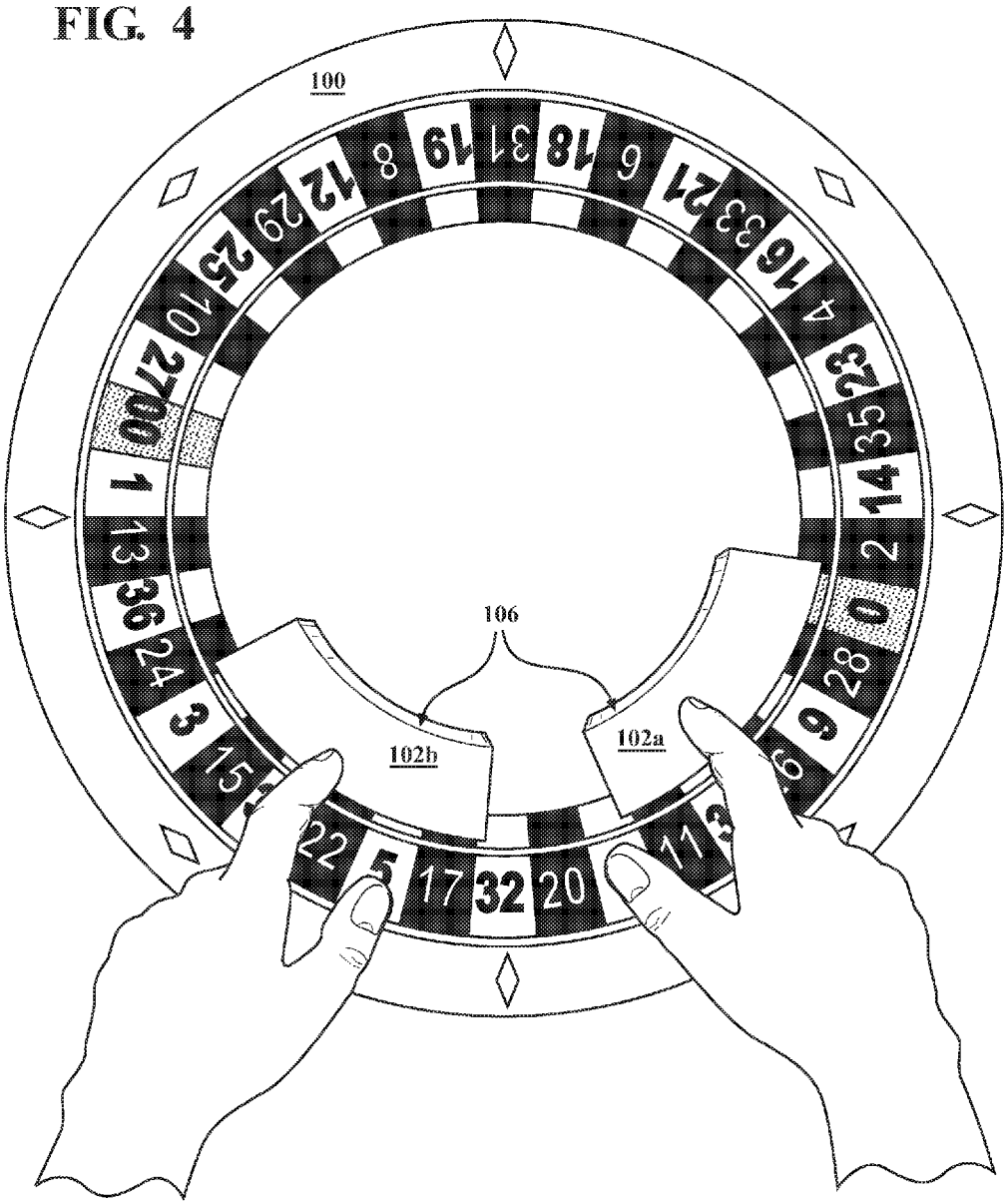
Figure 5:
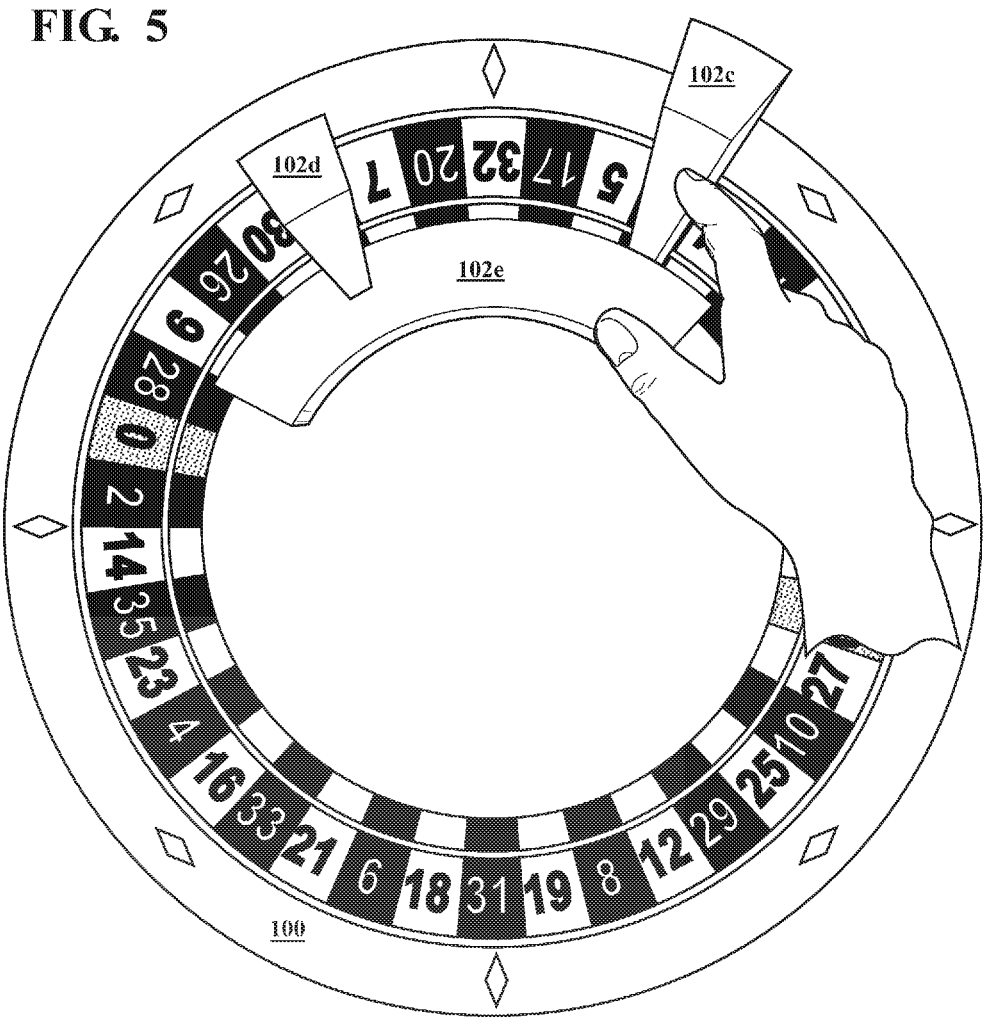

The thickness 106 of the form 102 as represented by the three-dimensional appearance of form 102, or alternatively a stack of forms, indicates the unit wager. In other embodiments, the color of the form may change depending on the denomination or amount of units wagered. As shown in FIG. 4, the thickness 106 of forms 102*a* and 102*b* increases to represent a greater amount wagered. As shown in FIG. 5, wagers placed on forms 102*c*, corresponding to a wager on the number 22, is a greater unit wager than forms 102*d* (on number 30) or form 102*e* (wager on eleven numbers), based on the greater three-dimensional appearance or "height" of form 102*c*. In some embodiments, the amount of the wager may be shown on the form.

Figure 6:
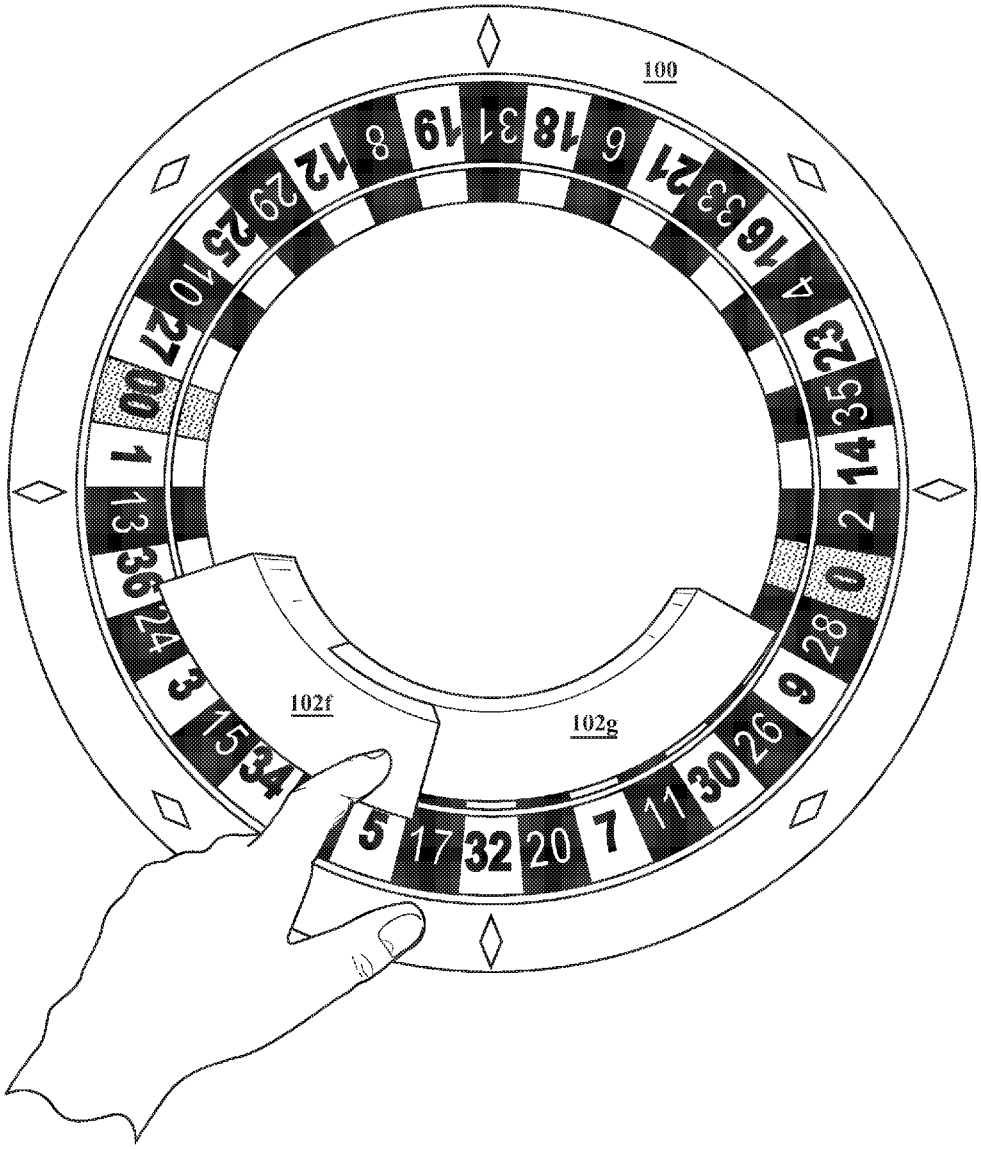

Other wagers may be placed, thus forming different graphical representations, such as 102*f*, which overlaps band 102*g*, as shown in FIG. 6. Overlapping positions may be selected based on various factors, such as based on the amount of unit wagered or order in which the wager is placed. Each overlapping band corresponds with a wager on a different number or group of numbers, and each may correspond with the same or different amounts of units wagered.

Figure 7:
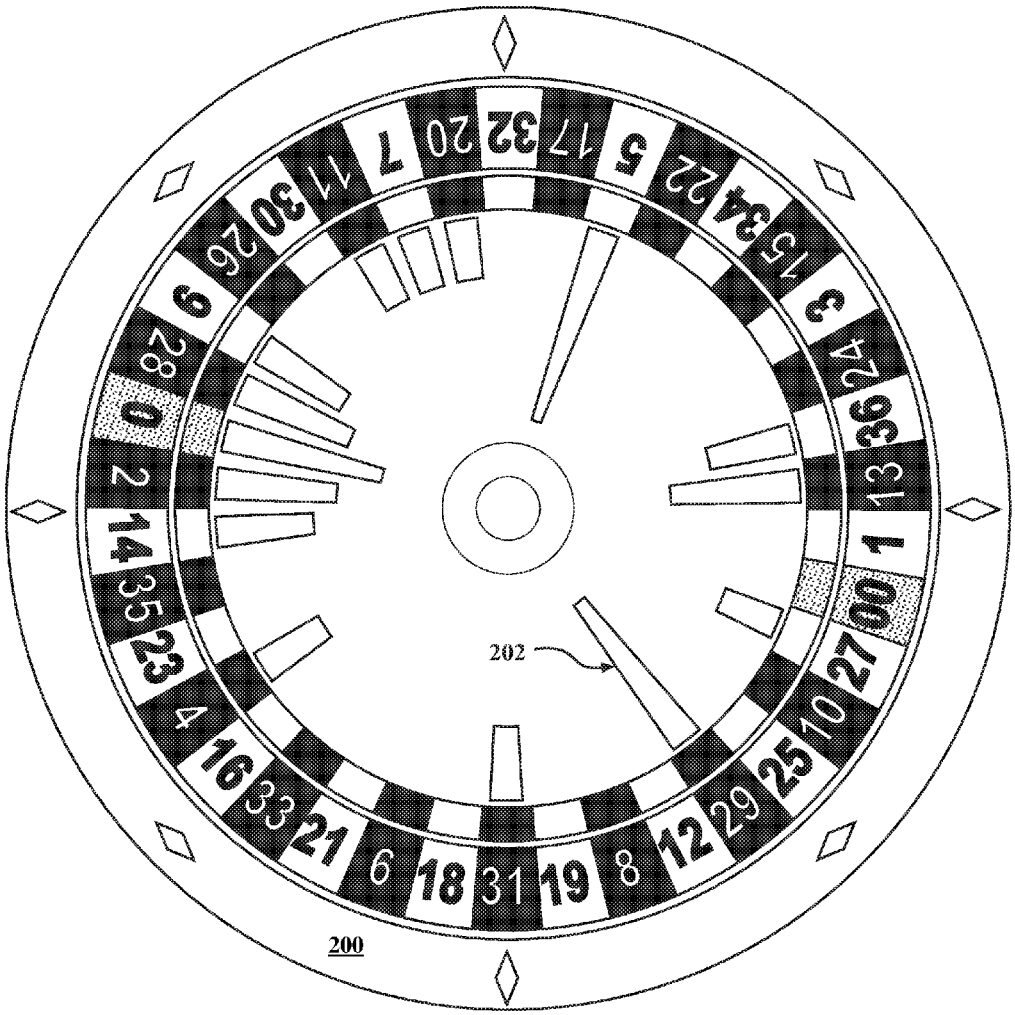
Figure 8:
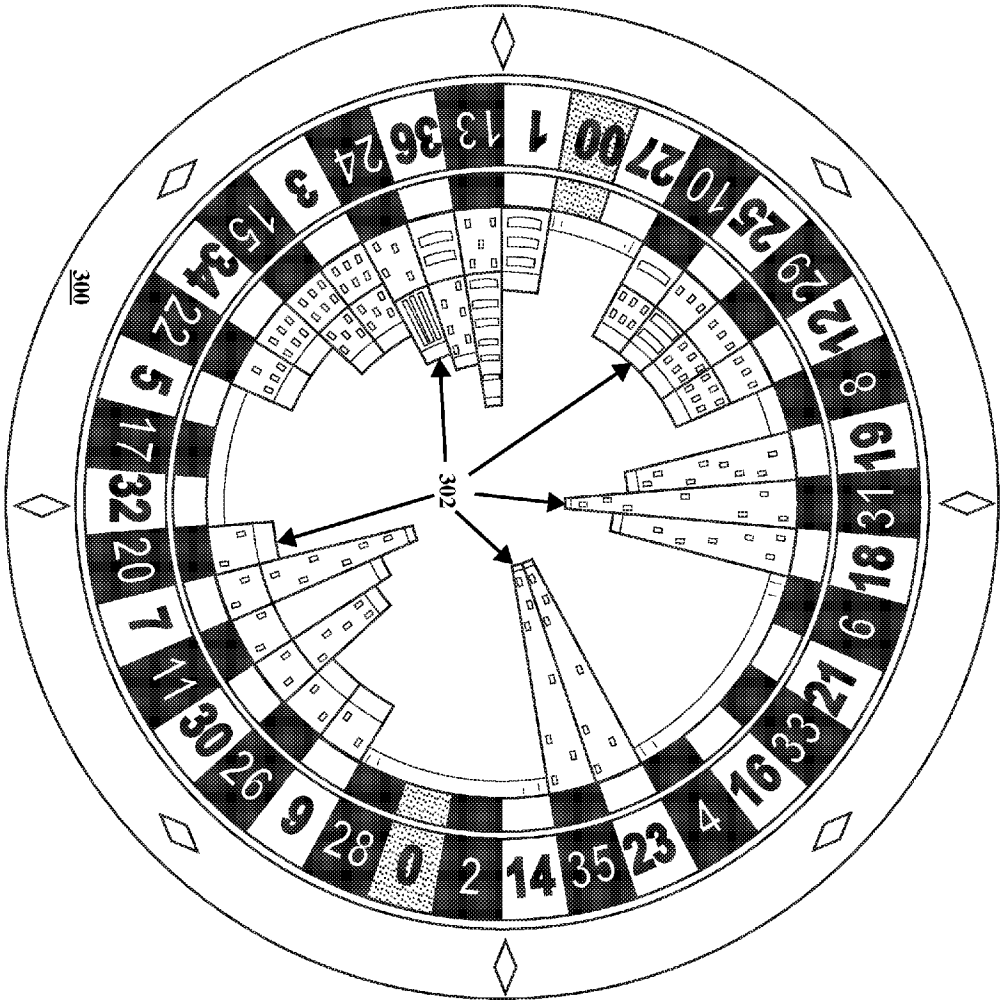

FIG. 7 illustrates an interface 200 with the forms 202 in a two-dimensional format which may be used at a player interface to visualize a single player's wagers. Alternatively, any of the embodiments herein, may be used to provide visualization of all player's wagers in the game or historical game player wagering and/or results, which may be displayed at a central location viewable to all players or at each player's user interface at all times or responsive to player selections made through the interface. FIG. 8 illustrates an interface 300 with forms 302 which are configured to appear as buildings with the amount of floors or "height" of each building representing wagering amounts.

It should be readily apparent that the form may be any visually distinguishable mark, such as indicia, patterns, text, characters or symbols, of any color or shape.

Those skilled in the art will readily appreciate that any of the systems and methods of the invention may include various computer and network related software and hardware, such as programs, executable instructions, operating systems, memory storage devices, data input/output devices, data processors, servers with links to data communication systems, wireless or otherwise, and data transceiving terminals, and may be a standalone device or incorporated in another platform, such as a mobile device. The system of the invention may be provided on electronic platforms with multiple player positions. In addition, the system of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with useful access thereto or the opportunity to play the game as described herein.

It should be understood that the aforementioned embodiments of the invention may be incorporated in a fully or partially automated or interactive, computerized platform supporting multiple player positions and wagering. It should be readily apparent that additional computerized or manual systems may also be employed in accordance with the invention in order to achieve its full implementation as a system, apparatus or method.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

The invention claimed is:

1. A method of facilitating wagering through an electronic player terminal operatively associated with a processor, a display device, memory and a program stored in the memory, the program being executable by the processor, the method comprising the steps of:

presenting, by the display device, a user interface comprising a representation of a segmented ring, wherein each segment of the displayed segmented ring corresponds with a wagering option associated with a wagering game;

receiving, through the user interface, input from a player relating to one or more desired wagers, wherein the input is received by detecting physical contact with the display device in a segment of the segmented ring; and responsive to the input received, presenting, by the display device, a graphical representation of the one or more desired wagers, wherein the graphical representation comprises a form visible on the user interface, the form having a positional element relative to the displayed segmented ring indicating the wagering option being wagered on and a dimensional element relative indicating an amount being wagered.

2. A method as recited in claim 1, wherein the segmented ring comprises a roulette wheel number ring.

3. A method as recited in claim 1, wherein the form is arcuate.

4. A method as recited in claim 3, wherein the form is positioned concentrically relative to the segmented ring.

5. A method as recited in claim 4, wherein the form is in a radially inner position relative to the segmented ring.

6. A method as recited in claim 4, wherein the form is in a radially outer position relative to the segmented ring.

7. A method as recited in claim 1, wherein the positional element comprises a radial position of the form relative to the wagering option being wagered on.

8. A method as recited in claim 1, wherein the dimensional element comprises a radial length of the form, wherein the radial length of the form is directly proportional to the amount being wagered.

9. A method as recited in claim 1, wherein the dimensional element comprise an axial appearance of the form, wherein the extent of the axial appearance of the form is directly proportional to the amount being wagered.

10. A method as recited in claim 1, further comprising the step of placing the one or more wagers in the wagering game corresponding to the input received.

11. A method of facilitating wagering through an electronic player terminal operatively associated with a processor, a display device, memory and a program stored in the memory, the program being executable by the processor, the method comprising the steps of:

presenting, by the display device, a user interface comprising a representation of a roulette wheel number ring;

receiving, through the user interface, input from a player relating to one or more desired wagers, wherein the input is received by detecting physical contact with the display device; and responsive to the input received, presenting, by the display device, a graphical representation of the one or more desired wagers, wherein the graphical representation comprises a form visible on the user interface, the form having a positional element relative to the displayed roulette wheel number ring indicating one or more roulette wheel numbers of the roulette wheel number ring being wagered on and a dimensional element relative indicating an amount being wagered.

12. A method as recited in claim 11, wherein the form is in a radially inner position relative to the displayed roulette wheel number ring.

13. A method as recited in claim 11, wherein the positional element comprises a radial position of the form relative to the one or more roulette wheel numbers being wagered on.

14. A method as recited in claim 11, wherein the dimensional element comprises a radial length of the form, wherein the radial length of the form is directly proportional to the amount being wagered.

15. A method as recited in claim 11, wherein the dimensional element comprises an axial appearance of the form, wherein the extent of the axial appearance of the form is directly proportional to the amount being wagered.

16. A system, comprising a) a display device configured to present a user interface comprising a representation of a segmented ring, wherein each segment of the displayed segmented ring corresponds with a wagering option associated with a wagering game; and b) a processor configured to:

i) determine one or more desired wagers to be placed in the wagering game based on the input received from a player, wherein the input is received by detecting physical contact with the display device;

ii) responsive to the input received, present on the display device, a graphical representation of the one or more desired wagers, wherein the graphical representation comprises a form visible on the user interface, the form having a positional element relative to the displayed segmented ring indicating the wagering option being wagered on and a dimensional element relative indicating an amount being wagered; and iii) determine the potential award to be provided in response to the one or more desired wagers being won in the wagering game.

17. A system as recited in claim 16, wherein the segmented ring comprises a roulette wheel number ring.

18. A system as recited in claim 16, wherein the positional element comprises a radial position of the form relative to a wagering option being wagered on.

19. A system as recited in claim 16, wherein the dimensional element comprises a radial length of the form, wherein the radial length of the form is directly proportional to the amount being wagered.

20. A system as recited in claim 16, wherein the dimensional element comprises an axial appearance of the form, wherein the extent of the axial appearance of the form is directly proportional to the amount being wagered.

* * * * *